United States Patent [19]

Harris et al.

[11] 4,383,492

[45] May 17, 1983

[54] FURLING SAIL WITH PROTECTIVE PANELS

[76] Inventors: Gerald W. Harris, 27 Green Acre La., Westport, Conn. 06852; John K. Marshall, Addison, Me. 04606

[21] Appl. No.: 227,657

[22] Filed: Jan. 23, 1981

[51] Int. Cl.[3] ..... B63H 9/04

[52] U.S. Cl. ..... 114/103; 114/106; 114/39

[58] Field of Search ..... 114/102, 103, 104–107, 114/39

[56] References Cited

U.S. PATENT DOCUMENTS

| | | | |
|---|---|---|---|
| 3,132,620 | 5/1965 | Court | 114/106 |
| 3,274,968 | 9/1966 | Hayes | 114/103 |
| 3,356,059 | 12/1967 | Ross | 114/103 |
| 3,602,180 | 8/1971 | Holmes | 114/106 |
| 3,903,826 | 9/1975 | Andersen | 114/103 |

*Primary Examiner*—Trygve M. Blix
*Assistant Examiner*—D. W. Keen
*Attorney, Agent, or Firm*—Gary, Juettner & Pyle

[57] ABSTRACT

A triangular sail is provided with vertical seams and panels at the leech and foot to protect the sail upon furling around the luff, the foot panel also serving to impart shape to the sail.

6 Claims, 4 Drawing Figures

FURLING SAIL WITH PROTECTIVE PANELS

BACKGROUND OF THE INVENTION

This invention relates to sails for sailing craft and more particularly to essentially triangular sails that are rigged in a manner to permit furling about the leading edge or luff of the sail.

Particularly in the case of cruising boats on which the sails are exposed to sunlight and air for long periods of time, the problem of sail deterioration is especially prevalent. Modern sails are made from cloth manufactured from synthetic polymers such as polyesters and polyamides, and the thread used to sew the sail panels together are composed of similar materials. It is well known that sunlight, particularly ultraviolet light, has an adverse effect on sail materials, and the effect is particularly severe in moderate or sunny climates. In cruising sailboats and other designed primarily for pleasure use, it is most convenient to furl the sails when not in use, rather than remove them. Since a portion of the sail still remains exposed, precautions are usually taken to protect the exposed surfaces, such as placing a protective cover over the furled sail.

In the case of triangular sails, the sail may be furled around its leading edge or luff, whereby the sail is rolled up around the luff while still being supported between the mast and deck of the boat. So-called roller furling gear may comprise a pair of swivels located respectively above the head and below the tack of the luff of the sail, with the swivels being connected to the wire or rod or other device that supports the sail luff. A spool or other rotating device in the lower swivel is used to rotate the luff of the sail and wind up the trailing portion around the luff device or head stay.

In order to protect the sail while being furled, it is known to sew protective layers or strips of material over one or both sides of the aft portion or leech of the sail and of the lower portion or foot area of the sail, which results in a laminate that forms the last wrap when the sail is furled, thereby protecting the furled sail. Such layer or layers, sewn over the body of the sail, however, add weight to the aft and lower portions and may tend to distort the shape of the sail. Also, since most sails have horizontal seams, some of the thread that attaches the protective layer to the sail remains exposed to the sun and is subject to deterioration.

SUMMARY OF THE INVENTION

The present invention provides a furling triangular sail wherein an elongate vertical panel along the leech and an elongate horizontal panel along the foot of the sail is composed of a single ply or panel of structural sail cloth treated chemically or coated to provide protection from sunlight and other weathering, rather than the conventional superimposed layer or cover. In addition, the panels forward of the leech are arranged substantially parallel with the leech or substantially vertically. The single ply panels at the leech and foot of the sail substantially eliminate the problem of exposed seams and thread and allow for a furling sail that is light in weight without sacrifice of strength or performance.

THE DRAWINGS

DESCRIPTION OF THE PREFERRED EMBODIMENTS

Figure 1:
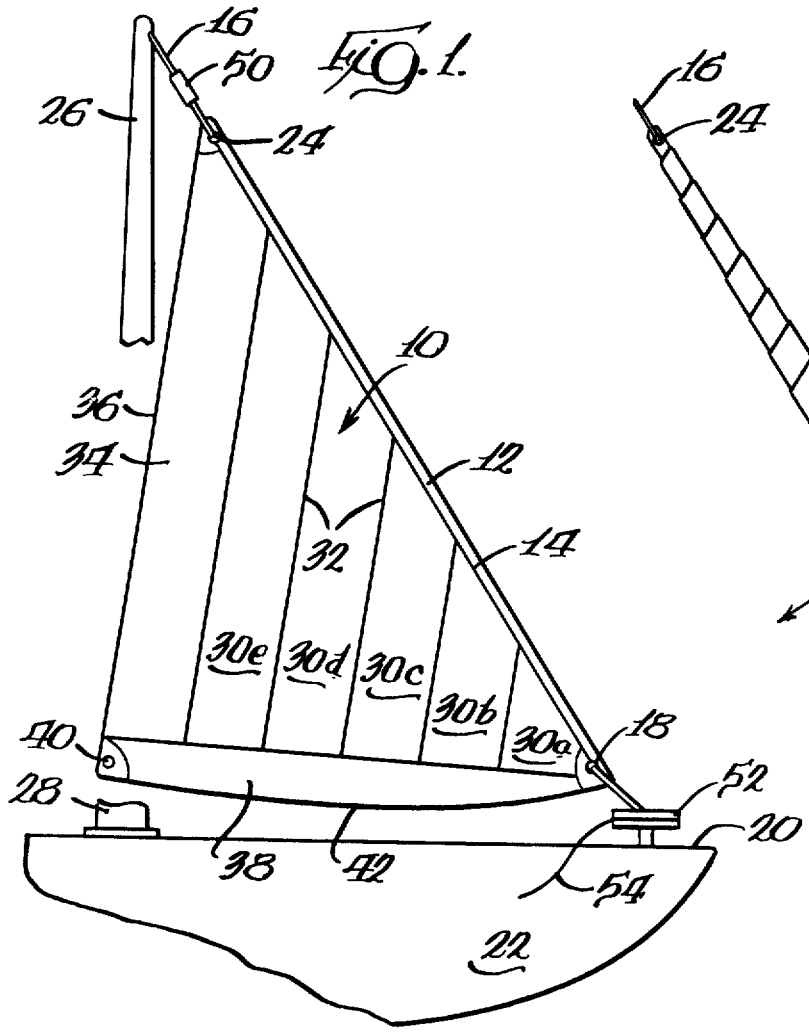
FIG. 1 is a side view of novel sail of the present invention, illustrating the sail in unfurled condition as rigged on a boat.

FIG. 1 illustrates a triangular foresail 10, such as a jib, having a leading edge or luff 12 with a seam 14 therein forming a channel disposed around or on the headstay 16 in a conventional manner. The sail is conventional in shape and includes a tack 18 attached to the deck 20 of the hull 22 and a top 24 attached to the mast 26, the base 28 of which mast is supported in the hull.

The sail is made up from a plurality of elongate panels 30*a*, 30*b*, 30*c*, 30*d* and 30*e* connected by overlapping sewn seams such as 32. A conventional foresail in general use today would have the seams running horizontally, i.e., substantially parallel to the deck 20. In contrast, the seams 32 of the upper panels of the sail of the present invention run substantially vertically.

The sail 10 includes a trailing panel 34, the free edge of which defines the leech 36 of the sail. Also included is a bottom panel 38 extending between the tack 18 and the clew 40 and defining the entire foot 42 of the sail. The foot panel 38 is preferably formed with a curved shape relative to the luff and body of the sail to impart a curved shape to the sail and to prevent the sail from flapping. It will be seen, therefore, that the upper portion of the sail comprises a plurality of upright elongate strips or panels, with the seams 32 being arranged substantially parallel to the leech 36, with the upper portion being connected to the continuous foot panel 38 extending entirely along the bottom portion of the sail.

In accordance with the prior art, it is known to protect the trailing and portions of the sail with protective edge strips which are sewn over the existing sail material to provide a multi-ply construction in the areas to be protected. These protective strips are generally of materials of lesser strength and stretch resistance than that used in the body of the sail. As a result, such strips do not contribute to the strength or performance of the sail. Due to the construction of the sail of the present invention, however, the leech panel 34 and foot panel 38 may be composed of a single ply material, which panels form an integral and structural part of the working sail.

Various types of treated or coated sail cloth are suitable for the panels 34 and 38 and provide protection from ultraviolet radiation and other weathering when the sail is furled, while still providing the full structural strength in the sail body. One type of cloth, for example, is made from polyester threads, and the cloth is then coated with a protective material such as an elastomer, i.e., a latex.

In the alternative, if a particularly rugged sail is required, to panels 34 and 38 may be composed of conventional sail cloth with a protective panel of the aforesaid material sewn or otherwise applied over one or both sides of these panels. The same desirable results in terms of configuration and furling are attained, with the added benefit of additional strength in the leech area, which is the portion subject to the greatest stress.

Although the use of vertically elongated panels are especially suitable for construction of the sail of the present invention, it is also possible and within the scope of the present invention to use horizontal seams along with the single ply leech and foot protective panels as hereinbefore described. Indeed, many of the benefits of the invention may be realized, regardless of the particular construction of the unprotected portions of the sail.

Figure 3:
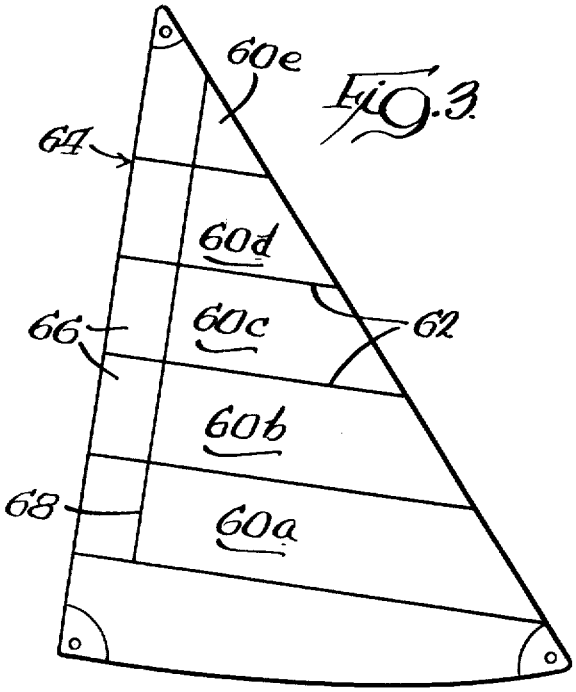
FIGS. 3 and 4 are plan views of other embodiments of a sail made in accordance with the present invention.

As shown in FIG. 3, a plurality of horizontally elongate panels, such as 60*a* through 60*e*, composed of conventional sail cloth, may be used to construct the major, unprotected portion of the sail, adjacent panels being joined together by horizontal seams, such as 62. The foot panel 64 is constructed from protective material, as in the previous embodiment. The leech panel, generally indicated at 64, may comprise a plurality of protective panels 66 joined together by a continuation of the horizontal seams 62. The leech panel is joined to the body of the sail preferably by a continuous vertical seam 68.

Figure 4:
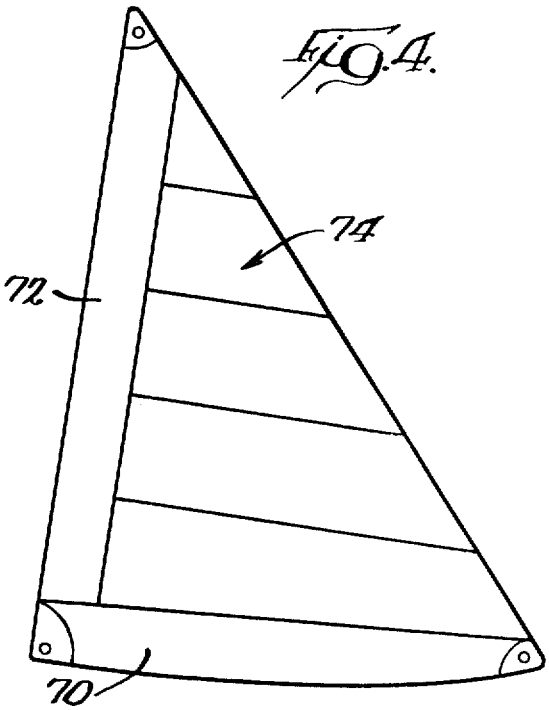

A similar embodiment is shown in FIG. 4 wherein a single ply foot panel 70 and a single ply continuous leech panel 72 is joined to the remaining horizontally seamed body 74 of the sail.

It will be understood by those skilled in the art of sail design that the seams shown in the various embodiments are shown as substantially straight lines for the sake of illustration, whereas in actual practice the seams and/or the outline of the panels may be curved or otherwise sewn together to provide body in the sail.

Conventional means are provided to furl the sail, which involves rotation of the luff 12 such that the trailing or aft portion of the sail is wound around the luff and headstay 16. Suitable apparatus for this purpose are commercially available, and, by way of example, are described in the following U.S. Pat. Nos. 3,800,729; 3,872,816 and 3,851,610.

By way of illustration, the furling gear may comprise an upper swivel 50 connected into the headstay 16 above the head 24 of the sail, and a lower spindle and swivel assembly 52 connected into the stay between the tack 18 and the deck 20. The apparatus is designed such that rotation of the spindle will cause the luff of the sail to rotate around its axis. A line 54 is wrapped around the spindle to effect the necessary rotation.

Figure 2:
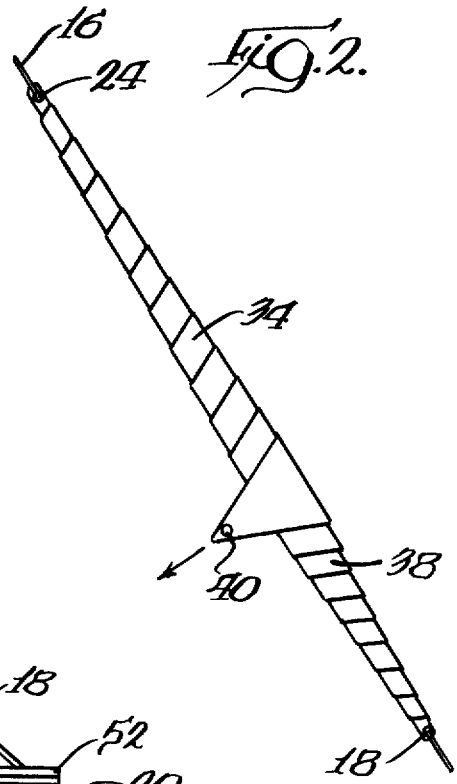
FIG. 2 is a side view of the sail shown in FIG. 1, with the sail shown in furled condition.

Assuming that the force on the clew 40 is released, rotation of the spindle 52 will cause the sail to wind up in the form of a tapered cylinder or cigar shape as shown in FIG. 2. When completely furled, the foot panel 38 will form a protective cover over the lower portion of the furled sail, and the leech panel 34 will cover the upper portion of the furled sail. Since the panels together are continuous and substantially unbroken from one end to the other, there are no major exposed seams or bare sail cloth that remain unprotected.

It will be understood that a line or sheet (not shown) is normally attached at the clew 40 of the sail in order to adjust the trim thereof. In order to unfurl the sail, tension on spool line 34 is released, and the clew 40 is pulled outward in the direction of the arrow in FIG. 2.

It may now be seen that the sail of the present invention offers several unique advantages that were heretofore unavailable. Constructing the sail with vertical seams in general provides for greater strength per unit weight and less stress on the seams than a sail with horizontal seams. Most importantly, the use of vertical panels 30*a* through 30*e* allows for single ply (and hence lighter weight) protective panels of the leech and foot, said panels being substantially continuous and seamless, so as not to leave any major seams exposed when the sail is furled. Thus, the advantages of a vertically seamed sail are combined with continuous single ply protective panels to provide a superior furling foresail that is light in weight without sacrifice to strength, performance or protection under furled conditions.

Another important advantage of the present invention is the incorporation of treated sail cloth panels as a structural and part of the sail, said panels also serving to protect the sail when furled.

We claim:

1. A furling sail having a luff, leech and foot, wherein the sail is wrapped around the luff in order to furl the sail, said furling sail comprising a plurality of elongate upright panels running between the luff and the foot of the sail, said upright panels being substantially parallel to the leech and being connected along their adjacent edges to define substantially vertical seams and including an upright panel at the leech, and a substantially horizontal and continuous foot panel extending along the foot of the sail and being connected to said upright panels, the foot panel and the upright panel at the leech each comprising at least one panel of weather protective material that together substantially cover the sail when furled about the luff thereof, whereby to cover and protect the body of the sail and the seams between said upright panels.

2. The sail of claim 1 wherein the foot panel has a curved configuration.

3. The sail of claim 1 wherein all of the panels of said sail are constructed from single ply material.

4. A furling sail having a luff, leech and foot, wherein the sail is wrapped around the luff in order to furl the sail, said furling sail comprising a major said body extending from said luff toward said foot and leech, a foot panel extending along the foot of said sail and being joined to the body thereof, said foot panel being made of a single ply of protective material, and a leech panel extending along the leech of said sail and being joined to the body thereof, said leech panel being made of a single ply of protective material, said foot and leech panels providing an integral and structural part of the sail, said foot panel and said leech panel together substantially covering and serving to protect the body of said sail when furled.

5. The sail of claim 4 wherein the body comprises a plurality of upright elongate joined panels.

6. The sail of claim 4 wherein the body comprises a plurality of horizontally elongate joined panels.

* * * * *